United States Patent [19]

Eriksson et al.

[11] Patent Number: 4,849,300

[45] Date of Patent: Jul. 18, 1989

[54] TOOL IN THE FORM OF A COMPOUND BODY AND METHOD OF PRODUCING THE SAME

[75] Inventors: Erik G. Eriksson, Sandviken; Rolf G. Oskarsson, Rönninge; Johan P. von Holst, Sandviken, all of Sweden

[73] Assignee: Santrade Limited, Lucerne, Switzerland

[21] Appl. No.: 796,208

[22] Filed: Nov. 8, 1985

[30] Foreign Application Priority Data

Nov. 9, 1984 [SE] Sweden ..... 8405628

[51] Int. Cl.[4] ..... B22F 7/04

[52] U.S. Cl. ..... 428/558; 428/564

[58] Field of Search ..... 428/558, 564, 565; 75/236, 238, 239, 240, 241, 242; 89/36.01, 36.02

[56] References Cited

U.S. PATENT DOCUMENTS

| | | | |
|---|---|---|---|
| 3,340,055 | 9/1967 | Cloran et al. | 419/28 |
| 3,816,081 | 6/1974 | Hale | 29/182.7 |
| 4,056,517 | 9/1977 | Saga . | |
| 4,082,559 | 4/1978 | Mishuku et al. . | |
| 4,143,208 | 3/1979 | Aslund | 428/558 |
| 4,145,213 | 3/1979 | Oskarsson et al. | 75/238 |
| 4,162,392 | 7/1979 | Brown et al. . | |
| 4,300,952 | 11/1981 | Ingelstrom et al. . | |
| 4,374,685 | 2/1983 | Suzuki et al. | 148/126.1 |
| 4,563,215 | 1/1986 | Yamamoto et al. | 75/238 |
| 4,608,318 | 8/1986 | Makrides et al. | 428/564 |
| 4,618,540 | 10/1986 | von Holst et al. . | |

FOREIGN PATENT DOCUMENTS

| | | | |
|---|---|---|---|
| 932342 | 8/1973 | Canada | 428/558 |
| 0046209 | 2/1982 | European Pat. Off. . | |
| 55-44533 | 3/1980 | Japan | 75/242 |
| 407781 | 3/1934 | United Kingdom . | |

*Primary Examiner*—John F. Terapane
*Assistant Examiner*—Eric Jorgensen
*Attorney, Agent, or Firm*—Burns, Doane, Swecker & Mathis

[57] ABSTRACT

Tools for machining etc can according to the invention be made better and cheaper by being composed of a compound material forming core and cover resp of the tool. The core consists thereby of a material which is situated in the gap between cemented carbide and high speed steel regarding its properties and which contains 30–70 vol % hard constituents in the form of carbides, nitrides and/or carbonitrides of Ti, Zr, Hf, V, Nb, Ta, Cr, Mo, and/or W in a matrix based on Fe, Ni, and/or Co and that the cover comprises an alloy based on Fe, Co and/or Ni generally steel and preferably tool steel or stainless steel.

12 Claims, 3 Drawing Sheets

TOOL IN THE FORM OF A COMPOUND BODY AND METHOD OF PRODUCING THE SAME

The present invention relates to tools in the form of compound bodies comprising cores and cover, whereby the core/cores contain a material rich in hard particles with lower content of hard constituents than normal sintered. cemented carbide whereas the cover comprises a softer material.

U.S. patent application Ser. No. 606,296, filed May 2, 1984, now U.S. Pat. No. 4,618,540 relates to tools of compound bar, where the core consists of high speed steel or tool steel whereas the cover consists of a difficulty ground material. The production of blanks for these tools can preferably be done by coextrusion. It has turned out that finegrained hardmaterial with so high content of hard constituents as 30–70 percent by volume can be extruded with good result and that also co-extrusion can be done of material with great differences in materials properties e.g. resistance to deformation.

A known way of producing compound products is to "co-sinter" two different materials. To obtain a dense product it is necessary that the solidus temperature for the most high melting alloy is exceeded. This leads to serious drawbacks for the low melting alloy on one hand and to an undesired and uncontrollable material transport through the transition zone on the other. For alloys with a lower content of hard constituents than cemented carbide a form collapse is obtained.

Isostatic hot pressing is a method where the aforementioned drawbacks have been eliminated. The method in itself is expensive. In addition certain conditions must be fulfilled. E.g. the compound body must have a closed pore system obtained by e.g. sintering, which is practically infeasible for two different materials together, or be enclosed in a gas tight capsule. Such a thing is relatively expensive and only comparatively large parts such as rolls can stand such a production cost.

Hot isostatic pressing gives also no increased strength due to plastic deformation of the body, which e.g. extrusion gives. Such a "kneading" gives better properties to the body.

The present invention relates to cutting, sawing, punching, forming etc tools such as end mills, drills, punches, knives, saws, scrapes, hobby tools etc. but also holding, guiding tools such as guiding rules etc.

In contrast to the tools according to the aforementioned patent, the tools according to the invention (as previously mentioned) are built up in such a way that the core/cores consist of the material rich in hard constituents whereas the cover consists of the softer material. The material rich in hard constituents is hereby situated in the gap between cemented carbide and high speed steel regarding its properties and contains 30–70 % by volume sub-micron hard constituents in the form of carbides, nitrides and/or carbonitrides of Ti, Zr, Hf, V, Nb, Ta, Cr, Mo, and/or W in a matrix based on Fe, Ni and/or Co. The cover can be an alloy based on Fe, Ni and/or Co, generally steel and preferably tool steel or stainless steel. Normally, the tool is so formed that the core is only partly surrounded by the cover. The free part of core is usually provided with one or more sharp edges.

Generally the matrix of the core material is based on iron. Normallly the material consists mainly of titanium nitride in a matrix of high speed steel type (and therein normally occurring carbide types) whereby the enriched hard particles have a grain size of $<1$ μm preferably $<0.5$ μm.

It has according to the invention turn out to be possible to plastically work finegrained hard particle-rich material with 30–70 % by volume hard constituents also by hot rolling provided that the material is present in compound form. The extreme limit of compound form has turned out to be with 'normal' extrusion can i.e. with a wall thickness of 3 mm for a can with the diameter 76 mm. When extruding a square rod 17x17 mm an outer cover is obtained varying between 1.0 and 1.5 mm along the sides. By careful handling and using a sufficiently oxidation resistant material in the cover, it has been possible to rôll this bar to a thickness of about 1 mm for the hard particle-rich material without the occurrence of edge fractures. After the rolling remaining part of the cover-can was removed by pickling. If the cover-can instead was removed before rolling, a crack-free material could not be obtained but edge damages appeared at an early stage.

Even if the lower limit of the wall thickness of the extrusion can has proved to be about 3 mm (for an extrusion can with 76 mm outer diameter) a wall thickness of preferably 7–8 mm for these cans is used in order to obtain a compound bar containing a core with 30–70 vol % fine grained particles which relatively easily is hot rolled.

By placing the hard material symmetrically or unsymmetrically in what may be regarded as a can of a softer material, which acts as a holder during extrusion and furthermore becomes an integrated part of the tool material, unique properties can be obtained. By choosing different materials as the tough part of the compound product, different properties are obtained. The hardmaterial has often relatively low thermal expansion and can thereby be given a favourable stress state. By the choice of e.g. stainless steel, which has a high thermal expansion, a very high grip on the hard material is obtained.

The object of a hardmaterial alloy with 30–70 vol % submicron hard particles was mainly to provide a material for sharp edges of tools etc. Problem was encountered however, to manufacture cutting tools by economically reasonable methods. A solution has, however, been presented in the said patent as to end mills, drills, broaches and similar tools for cutting of metals, i.e., tools from rotation symmetrical bars. The present invention has now solved the problem also for thinner tools such as punches, knives, saws etc as well as for unique geometric solutions for drills, end-mills etc as will be shown in the examples. It has surprisingly enough proved to be possible also for a non-professional to work out sharp eges which have shown surprising properties. As an example it can be mentioned that paper-knives have been ground from the aforementioned rolled material bar with a thickness of about 1 mm. Furthermore, hobbytools such as paintscrapers with complicated shapes have been produced in compound form and shown superior properties in the form of retained sharp edge and the ability to keep clean of smearing paint, particularly when heating has been used to remove old paint. Various forming and scraper tools with superior properties in the form of well retained wear resistance sharp edges combined with the ability to tolerate a large deflection when used, have been produced.

When the hard particle-rich materials have been located unsymmetrically, it has proven that when extruding flat profiles the profile orientates itself in a certain way and thereby readily "moves" the hard particle-rich material towards the sides. This has turned out to be due to a more favorable material flow that is obtained through the extrusion die itself.

As have been mentioned before, unsymmetrically located cores of hard material can also be used for unconventional solutions of new geometries for drills, end mills etc. If a flat profile of the type mentioned above is twisted after extrusion to form a helix, this helix can be used as a bar for production of twist drills with the hard material located as the margins. The core is of course made of high speed steel for such a purpose. Furthermore a drill for short hole drilling can be produced directly from the flat profile without twisting.

Instead of extruding a flat profile from a billet with unsymmetrically located hard material a round bar can be extruded as well. This extrusion means an area reduction but the location of the hard material is not influenced as much. Also such a bar can be twisted in the hot condition; i.e., directly after extrusion, to the angle wanted for the flute of the cutting tool to be produced later. Also, it is not necessary to twist the bar to produce a short hole drill for example.

It is also possible to use just a short bit of this fairly expensive bar by making a hard top of the material according to the invention and friction weld (or another method) it onto a shank. The shank can also be a tube with a fairly small hole in the center. It is then easy to drill short small chamfered holes from the flank surfaces of the chisel edge to this center hole to the shank. When producing a tool, this shank can as well be formed as a flute for the transport of the chips. The holes are, of course, made for supply of coolant. The coolant has a very effective positive influence on both the cutting process and the chip transformation. A two-flute tool can be produced by placing two strings of hard material in the cover/can. A three-flute tool needs three strings and so on.

The geometric solutions discussed above will be further illustrated in the examples.

BRIEF DESCRIPTION OF THE DRAWINGS

The invention will be described more in detail by the following specification and drawings which show.

Figure 1:
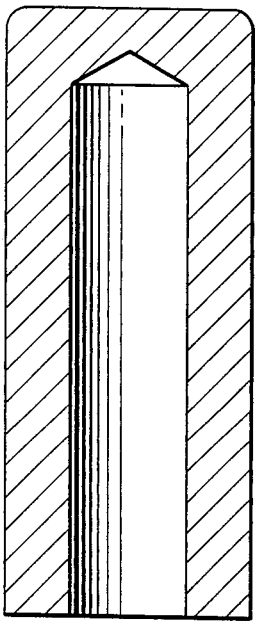
FIG. 1 shows a compound material blank in logitudinal section.

Compound semifinished products in the form of extruded flat profiles have tuned out to be surprisingly easy to roll down to band steel which will be shown in the examples later. Such bands have been possible to bundle together in packages and from the bandpackages it has turned out to be possible, with the help of conventional methods of working steel, to mill/grind e.g. sawblades with the relatively small working parts in material rich in hard particles, a product which has not been possible to produce earlier. It has been possible because the working tools i.e. milling and/or grinding tools, do not 'experience' the material enriched in hard particle to the extent that it really is present but 'see' only a small part by the alternating structure. It has also turned out that grinding wheels obtain a selfcleaning effect by working in alternately hard and soft areas situated close to one another. Among the applications which advantageously can start from compound bands according to the invention can be mentioned knives for surgical purposes and when thin sharp edges are needed e.g., so-called professional razor blades. Also oridinary razor blades are within the possible limits of obtainable products.

Bands with unsymmetrical location of the hard-material according to earlier description have also turned out to be an excellent material for the producton of thin tools for machining of metals and wood e.g. cutting-off tools. A common problem with thin cutting tools is fracture as a result of too great a deflection. By placing our material on a backmaterial of spring steel the tool withstands a great deflection before fracture.

Bands with a string of hardmaterial in each end of the cross-section can with advantage be rolled to a somewhat neckshaped profile of the cross-section i.e with a waist. From such a band one can with advantage grind out the hard material and also grind a notch in its upper edge. In this way a reversible tool bit for parting off and other turning operations e.g. production of thin grooves is obtained.

The examples below show what is possible to obtain within the invention:

EXAMPLE 1

A blank with diameter 69+1 mm was pressed cold isostatically at 200 MPa. The composition of the hard-material powder used was 24.5 % Ti, 7 % N, 0.6 % C, 7.5 % Co, 6 % W, 5 % Mo, 4 % Cr and the rest Fe (and normally present other alloying elements and impurities ). Such a powder contains about 50 vol-% submicron hard particles in the form of TiN. The cold isostatically pressed blank was placed in an extrusion can of stainless steel with inner diameter 70 mm and a wall thickness of 3 mm. The can was closed by welding and evacuated through a thin evacuation pipe under heating at 600° C. after which the pipe was closed. Finally the extrusion took place after heating to 1150° C. for 45 min through an extrusion die 17×17 mm. The profile obtained in this way was rolled down stepwise to a total wall thickness of about 1.5 mm in the following way: The blank was heated to a temperature between 1125 and 1150° C. The first trip was run with 50 % reduction, whereupon the degree of reduction was gradually reduced to the order of 20 % per trip. This rolling continued down a thickness of 3.5 mm. After cooling and cleaning the blanks were examined. No defects could be detected. After renwed heating to 1150 ° C. a careful reducing rolling was performed down to a thickness of 1.5 mm of the hard material. The remaining can material was removed by careful pickling about 15 min in 30 % $HNO_3$, 5% HF and 65 % water at about 50 ° C. From the bands obtained in such a way various products such as paperknives paintscrapes etc., have been manufactured. These products are characterised in that a very sharp edge is obtained and that this edge is retained sharp in a completely different way than for competing products e.g. tool steel and high speed steel. This applies in particular when using in heavily wearing material.

EXAMPLE 2

Figure 2:
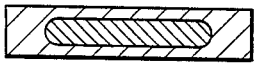
FIG. 2 shows the compound material blank of FIG. 1 after extrusion.

In order to obtain compound band with relatively small amounts of hardmaterial in the middle an extrusion can of stainless steel, SS 2333, was first produced according to FIG. 1. The outer diameter was 77 mm and that of the hole in the centre 50 mm. The length of the can was about 200 mm. A core of hardmaterial was pressed coldisostatically at 200 MPa and polished so that it just slid down into the can. A rear plug with the diameter 50 mm was inserted about 10 mm into the can whereafter the whole thin was closed by welding. After heating to 1175 ° C. 60 min the extrusion took place through a die 42×8mm. Hereby a cross-section profile according to FIG. 2 was obtained. This flat bar was rolled after heating to 1190 ° C. with 50 % reduction in height in the first trip. A band 47×4 mm was obtained. After the second trip the dimensions were 48.7×1.9 mm and after the third 50.8×1.3 mm. Thereafter the rolls were brought towards each other and after the fourth and final trip the dimension of the band was 52.5×0.96 mm. The dimension of the hard material was 32.9×0.35 mm.

EXAMPLE 3

Figure 3:
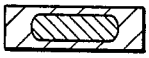
FIG. 3 also shows a cross-section of a compound material blank after extrusion.

The corresponding can as in the previous example but made of knife or razor blade steel and with a centre hole diameter of 40 mm was filled manually with hardmaterial powder which then of course gives lower filling density. The can was closed in the same way as in the preceding example. After heating to 1160 ° C., 60 min it was extruded through a die 24×6 mm. Hereby a cross-section profile of the hardmaterial 10×2.0 mm according to FIG. 3 was obtained. Due to the lower content of hard material there were no problems to roll down to corresponding thickness as in the preceding example.

EXAMPLE 4

Figure 4:
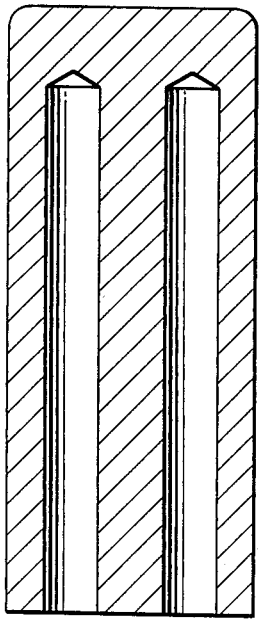
FIG. 4 shows a compound material blank with two powder inserts.
Figure 5:
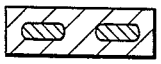
FIG. 5 shows the compound material blank of FIG. 4 after extrusion.
Figure 6:
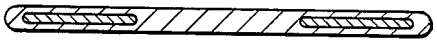
FIG. 6 shows the compound material blank of FIG. 5 after rolling.

For an unsymmetrical location of the hard material an extrusion can with two holes according to FIG. 4 was made. The holes had the diameter 25 mm and the distance between the centres was 40 mm. The material of the can was SS 2333 and its outer diameter 77 mm and length about 200 mm. The powder was filled manually into the two holes. After closing according to the preceding example it was heated to 1175 ° C. during 60 min, whereafter extrusion through a die 24×8 mm was performed. The blank was aligned in the die through a groove which had been ground in the rear plate as guide mark. A flat bar was obtained with a cross-section according to FIG. 5. The bar was cooled blasted and heated again to 1190 ° C., whereafter it was rolled in four trips to 36.6×0.95 mm. The location of the hard material is shown in FIG. 6. The dimensions of the hard material was 8×0.25 mm.

EXAMPLE 5

Figure 7:
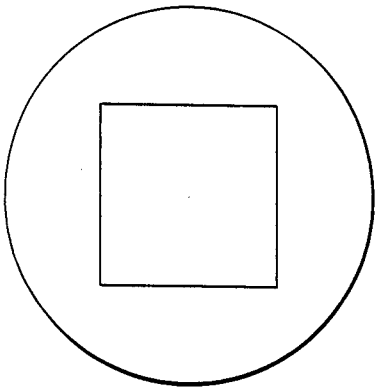
FIG. 7 shows a compound material blank with a round outer layer and a square inner material.
Figure 8:
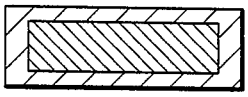
FIG. 8 shows the compound material blank of FIG. 7 after extrusion.

As an example of that also other forms of the hard material than round can be present as original form before the extrusion an attempt was made with the object of the obtaining sharp edges and corners of the hard material after the heat treatment. The core was shaped as a square according to FIG. 7. The result after the extrusion then did not become elliptical but a square cross section was obtained, FIG. 8. Such a profile is suitable to uncover by pickling after finished hot working.

EXAMPLE 6

Figure 9A:
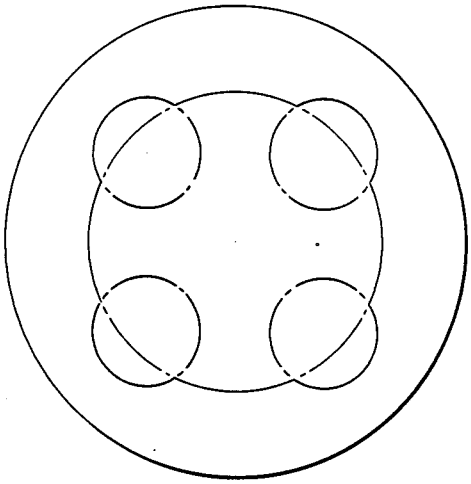
FIG. 9A shows a compound material blank having multiple inserts in cross-section.
Figure 9B:
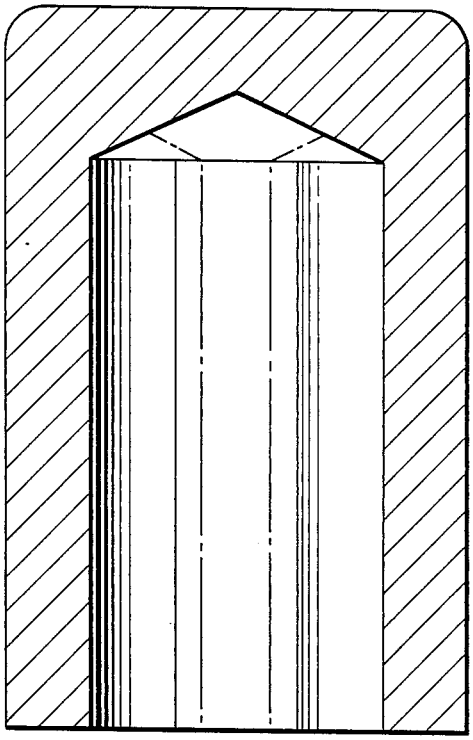
FIG. 9B shows the compound material blank of FIG. 9A in longitudinal cross-section.

A cheaper way of making a "square" hole which simultaneously gives rounded corners (and also somewhat "wavy" profile of the hardmaterial in the extruded bar) and thereby lesser stress concentrations in the corners in question is shown in FIG. 9. First four smaller holes are drilled, which constitutes the corners, and thereafter a larger centre hole is drilled. Sharp edges are of course broken such that the sides are smoothed in the extent as is needed for the profile desired.

EXAMPLE 7

Figure 10:
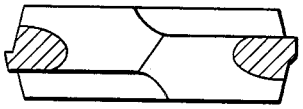
FIG. 10 shows a twist drill formed from a compound material blank of FIG. 4.
Figure 11:
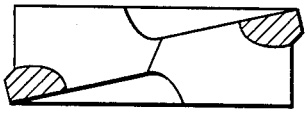
FIG. 11 is a spade drill made from the compound material blank of FIG. 4.

In a can of the same type as in example 4, but made of high speed steel grade M2, the holes were filled with the same powder as in example 1. The outer dimension of the can was 77 mm, the two holes had a diameter of 25 mm and the distance between the whole centres was 43 mm. The length of the can was about 200 mm. After closing according to the earlier examples, the can was heated to 1175° C. during 60 min and thereafter extruded through a die 24×8 mm. The same type of profile as in example 4, which is illustrated in FIG. 5, was obtained. One part of the extruded bar was cut off and then twisted while it was still hot after extrusion (about 1000° C.) to give an helix angle of 30°. Another part was not twisted. After cutting to blanks and heat treatment (hardening plus tempering) 20 mm drills were manufactured, "twist-drills" from the twisted bar and a kind of spade drills in the form of inserts from the non-twisted bar. The profile of the chisel edge of the "twist-drill" is shown in FIG. 10 and of the spade drill in FIG. 11.

EXAMPLE 8

Figure 13:
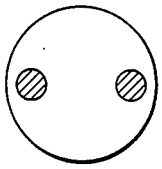
FIG. 13 shows the compound material blank after extrusion.
Figure 14:
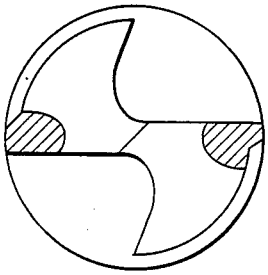
FIG. 14 is a drill manufactured from the compound material blank of FIGS. 12 and 13.
Figure 12:
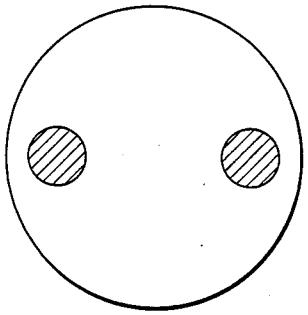
FIG. 12 shows the compound material blank of FIG. 4 after extrusion.

The same type of cans as in example 7 was also used to produce round bars. When extruding (as described in example 7) through a die with diameter 24 mm a profile according to FIG. 12 was obtained and when using a 12 mm diameter die a profile according to FIG. 13. Also parts from these bars were twisted or not as in the previous example. From these blanks, drills were manufactured. The geometry of the chisel edges is shown in FIG. 14.

EXAMPLE 9

For the manufacture of three-flute twist-drills, a can or billet of high speed steel with three symmetric holes with diameter 25 mm was prepared and filled with the same type of powder and extruded as in the previous examples through a die with 24 mm diameter. Three-flute drills, diameter 20 mm were manufactured. From this bar, diameter 20 mm high "hard tops" were cut and friction welded to a shank of tool steel with a center hole, diameter 3 mm. Holes with diameter 2 mm were drilled from the flank surfaces to the center hole to provide cooling.

We claim:

1. A solid compound body of a core and a cover, said core consisting essentially of a hard material of from 30 to 70 volume percent of particles having a grain size of less than 1 m selected from the group consisting of carbides, nitrides, carbonitrides and mixtures thereof of Ti, Zr, Hf, V, Nb, Ta, Cr, Mo, and/or W in a matrix based on a metal selected from the group consisting of iron, nickel, cobalt and mixtures thereof, said core being completely encapsulated within the cover, said cover consisting essentially of an alloy based on a metal selected from the group consisting of iron, nickel, cobalt and mixtures thereof, wherein the core is disposed unsymmetrically within the cover with respect to a central axis of the solid compound body.

2. The solid compound body of claim 1 wherein the hard material is mainly titanium nitride.

3. The solid compound body of claim 12 wherein the matrix of the core is iron or an iron-based alloy.

4. The solid compound body of claim 1 wherein the alloy of the said cover is a steel.

5. The solid compound body of claim 4 wherein the steel is selected from the group consisting of a high speed steel, a tool steel or a stainless steel.

6. A solid compound body of a plurality of cores and a cover, each said core consisting essentially of a hard material of from 30 to 70 volume percent of particles having a grain size of less than 1 $\mu$m selected from the group consisting of carbides, nitrides, carbonitrides and mixtures thereof of Ti, Zr, Hf, V, Nb, Ta, Cr, Mo, and/or W in a matrix based on a metal selected from the group consisting of iron, nickel, cobalt and mixtures thereof, each said core being completely encapsulated within the cover, said cover consisting essentially of an alloy based on a metal selected from the group consisting of iron, nickel, cobalt and mixtures thereof.

7. The solid compound body of claim 6 wherein the hard material is mainly titanium nitride.

8. The solid compound body of claim 7 wherein the matrix of the core is iron or an iron-based alloy.

9. The solid compound body of claim 6 wherein the alloy of the said cover is a steel.

10. The solid compound body of claim 9 wherein the steel is selected from the group consisting of a high speed steel, a tool steel or a stainless steel.

11. The solid compound body of claim 6 wherein the said several cores are disposed symmetrically within the cover.

12. The solid compound body of claim 6 wherein the said several cores are disposed unsymmetrically within the cover.

* * * * *

UNITED STATES PATENT AND TRADEMARK OFFICE

CERTIFICATE OF CORRECTION

PATENT NO. : 4,849,300

DATED : July 18, 1989

INVENTOR(S) : Rolf G. Oskarsson et al.

It is certified that error appears in the above-identified patent and that said Letters Patent is hereby corrected as shown below:

Title page of patent, "Erik G. Eriksson, Sandviken;" should be deleted.

Column 2, line 4, "turn" should read -- turned --;
line 55, "eges" should read -- edges --; and
line 66, "resistance" should read -- resistant --.

Column 4, line 54, "69+1" should read -- 69±1 --.

Signed and Sealed this

Twenty-sixth Day of May, 1992

*Attest:*

DOUGLAS B. COMER

*Attesting Officer*

*Acting Commissioner of Patents and Trademarks*